US007161076B2

(12) United States Patent
Lin

(10) Patent No.: US 7,161,076 B2
(45) Date of Patent: Jan. 9, 2007

(54) BUTTON STRUCTURE OF SAXOPHONE

(75) Inventor: Wei-Fu Lin, Fengyuan (TW)

(73) Assignee: Chia-Chun HSU, Taipei (TW)

( * ) Notice: Subject to any disclaimer, the term of this patent is extended or adjusted under 35 U.S.C. 154(b) by 44 days.

(21) Appl. No.: 11/058,242

(22) Filed: Feb. 16, 2005

(65) Prior Publication Data

US 2006/0180001 A1 Aug. 17, 2006

(51) Int. Cl.
*G10D 7/00* (2006.01)

(52) U.S. Cl. ..... 84/380 R

(58) Field of Classification Search ..... 84/380 R, 84/381, 382, 384, 385 R, 387 R
See application file for complete search history.

(56) References Cited

U.S. PATENT DOCUMENTS 4,453,445 A * 6/1984 Todd ..... 84/385 R

* cited by examiner

*Primary Examiner*—Kimberly Lockett
(74) *Attorney, Agent, or Firm*—Rabin & Berdo, P.C.

(57) ABSTRACT

A button structure of saxophone comprising of a treble E button, a side C linking rod button and a side B linking rod button; the bottom of the treble E button and the top of the side C linking rod button oblique upward 25° from left to right, the intersection and the horizontal direction of the finger hook form an upward 25° angle; the highest curve point of the side C linking rod button and the side B linking rod button are on the ¾ of the side C linking rod button and the side B linking rod button respectively, then declines from the high points downward on both sides to the rims of both buttons; players fell the reduction of the height difference and increase the contact area while playing that offers smoother play with less errors.

2 Claims, 4 Drawing Sheets

BUTTON STRUCTURE OF SAXOPHONE

BACKGROUND OF THE INVENTION

I. Field of the Invention

This invention relates generally to a button structure and, more specifically, to a button structure of saxophone that modifies the shape of treble E button, C button and bass Bb button, such design not only meet ergonomics requirement, players also fell the reduction of the height difference and increase the contact area while playing, players can play smoothly without errors.

II. Description of the Prior Art

Heretofore, it is known that the play of current saxophones is to have players' right thumb fix on finger hook, then apply the third finger section of the index finger to play side Bb linking rod button, side C linking rod button and treble E button for corresponding sound.

Referring to FIG. 1, FIG. 2 and FIG. 2A, that shows the arrangement of these buttons, from top to down, they are treble E button a1, side C linking rod button a2 and side Bb linking rod button a3; to view these buttons a from one side, they stretch down from the center high point and decline on right and left sides symmetrically, a finger hook b is installed on the back of these buttons a; when players press side C linking rod button a2 and side Bb linking rod button a3, they might feel uncomfortable by the angle difference, then when the third finger section c1 of the index finger c moves up, the contact areas of the third finger section c1 and buttons a move from left to right, since the highest point is on the center of the buttons a and is symmetrical from right to left side, it is possible to make index finger c not able to reach to the right spot but index finger c has to presses down and moves to right to ¾ of surface of the buttons a, and has to pass the curve of the highest point then move downward, the player might feel the long curve and height difference; when players play treble E button a1, side C linking rod button a2, they have to take finger hook b as a center of circle and turn upward for certain angle to play smoothly, however the intersection area of the known buttons a is parallel in horizontal direction, players might press the wrong buttons and not able to play smoothly.

SUMMARY OF THE INVENTION

It is therefore a primary object of the invention to provide a button structure of saxophone that not only meets ergonomics requirement, players also fell the reduction of the height difference and increase the contact area while playing, players can play more smoothly without errors.

In order to achieve the objective set forth, a button structure of saxophone in accordance with the present invention comprises of a treble E button, a side C linking rod button and a side Bb linking rod button; the bottom of the treble E button and the top of the side C linking rod button oblique upward 25° from left to right, the intersection and the horizontal direction of the finger hook form an upward 25° angle; the highest curve point of the side C linking rod button and the side Bb linking rod button are on the ¾ of the side C linking rod button and the side Bb linking rod button respectively, then declines from the high points downward on both sides to the rims of both buttons.

Based on above description and many ergonomics experiments, the intersection of the treble E button, the side C linking rod button is in 25° angle with the horizontal direction of the finger hook, player has the right thumb fix on the finger hook as the center point and become the center of circle of index finger and palm, when player play side Bb linking rod button, the index finger remains still; when plays play treble E button and side C linking rod button, index finger has move up counter-clockwise, while turning to the upper rim, the angle is 25°, such arrangement makes players have more operation room and smoother to reduce errors. When the finger contact area switches from the larger curve to smaller curve, since the highest curve point are on the ¾, players fell the reduction of the height difference and increase the contact area while playing that offers smoother play with less errors.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
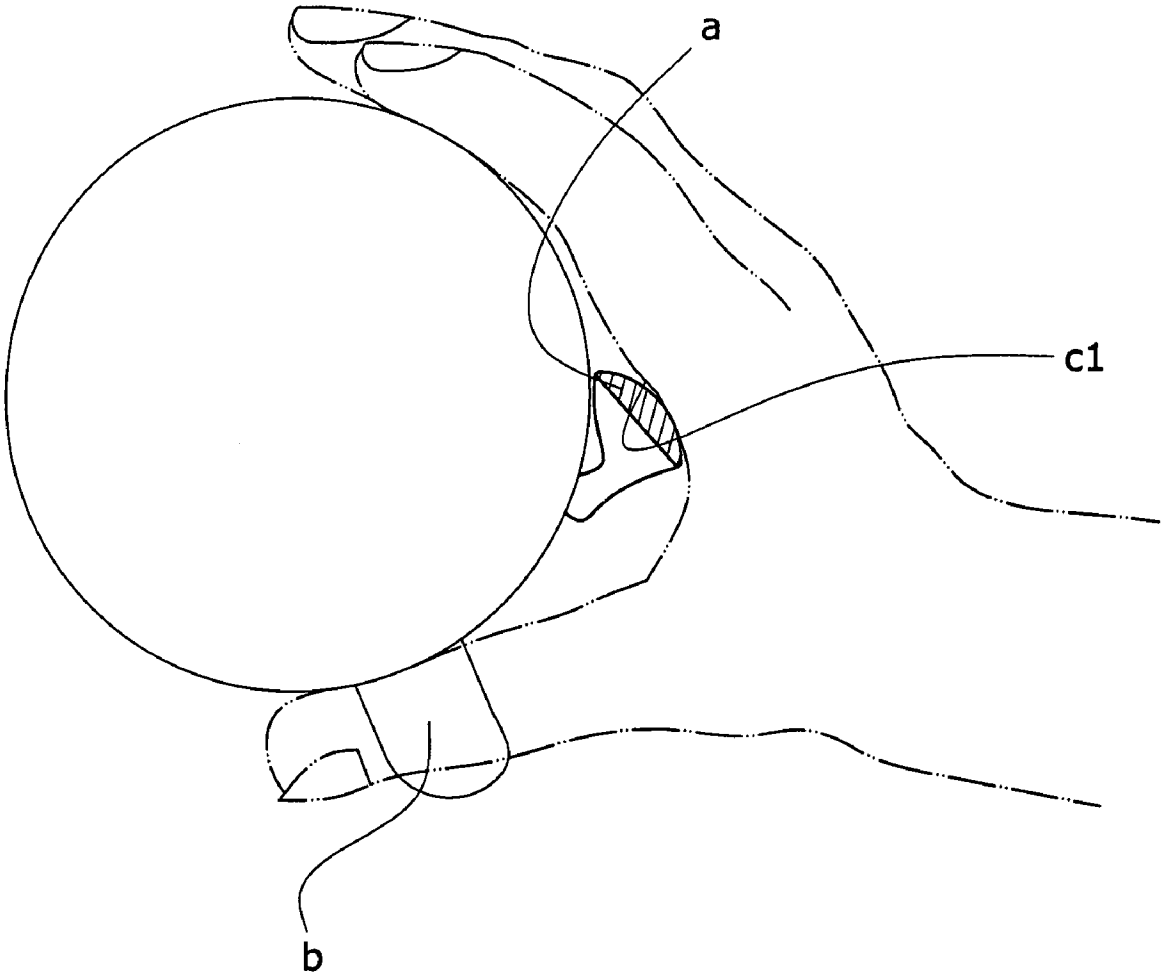
Fig.1 PRIOR ART
FIG. 1 is a top view of the prior art.
Figures 2, 2A:
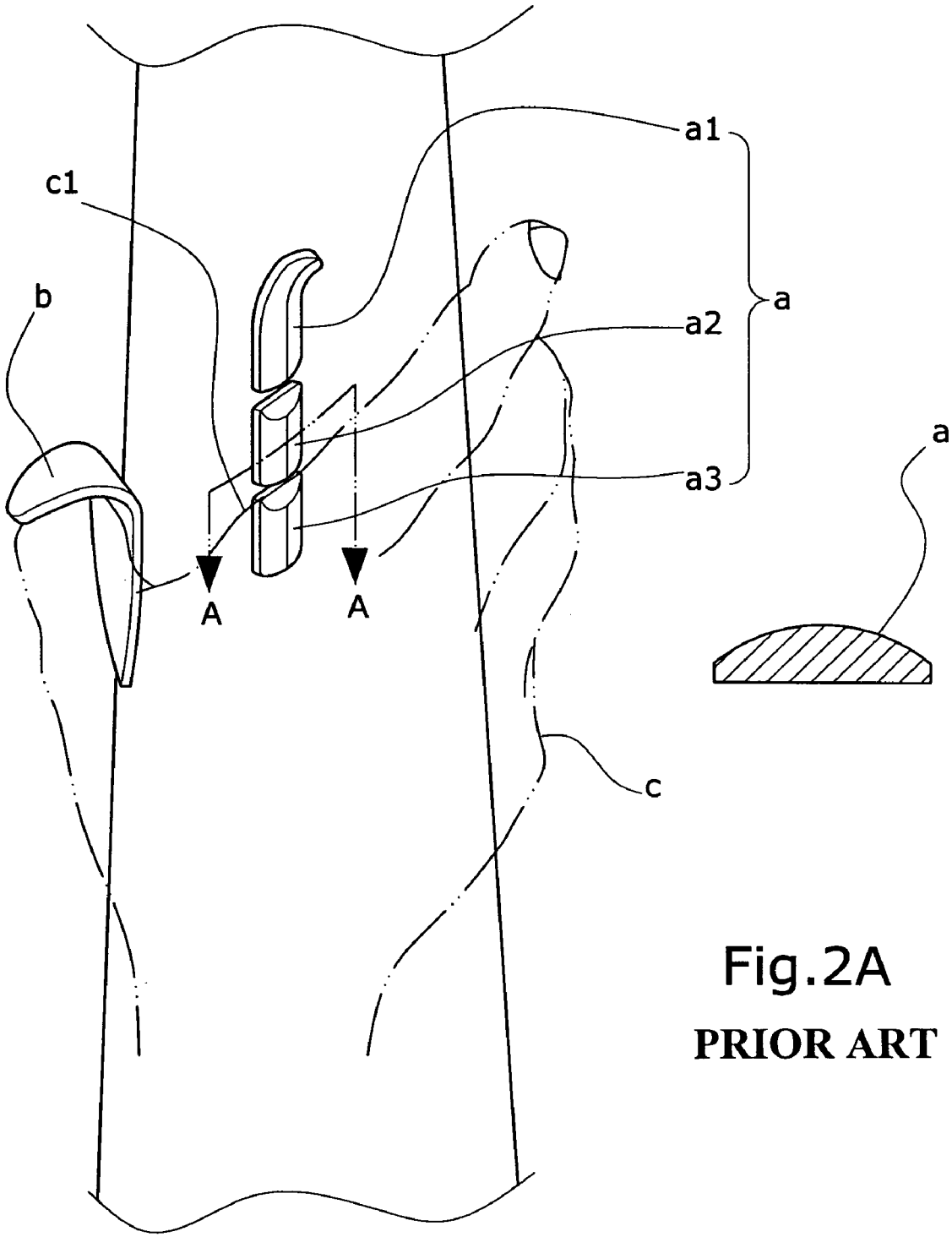
Fig.2A PRIOR ART
Fig.2 PRIOR ART
FIG. 2 is a side view of the prior art.
FIG. 2A is a cross-sectional view of the prior art.
Figure 3:
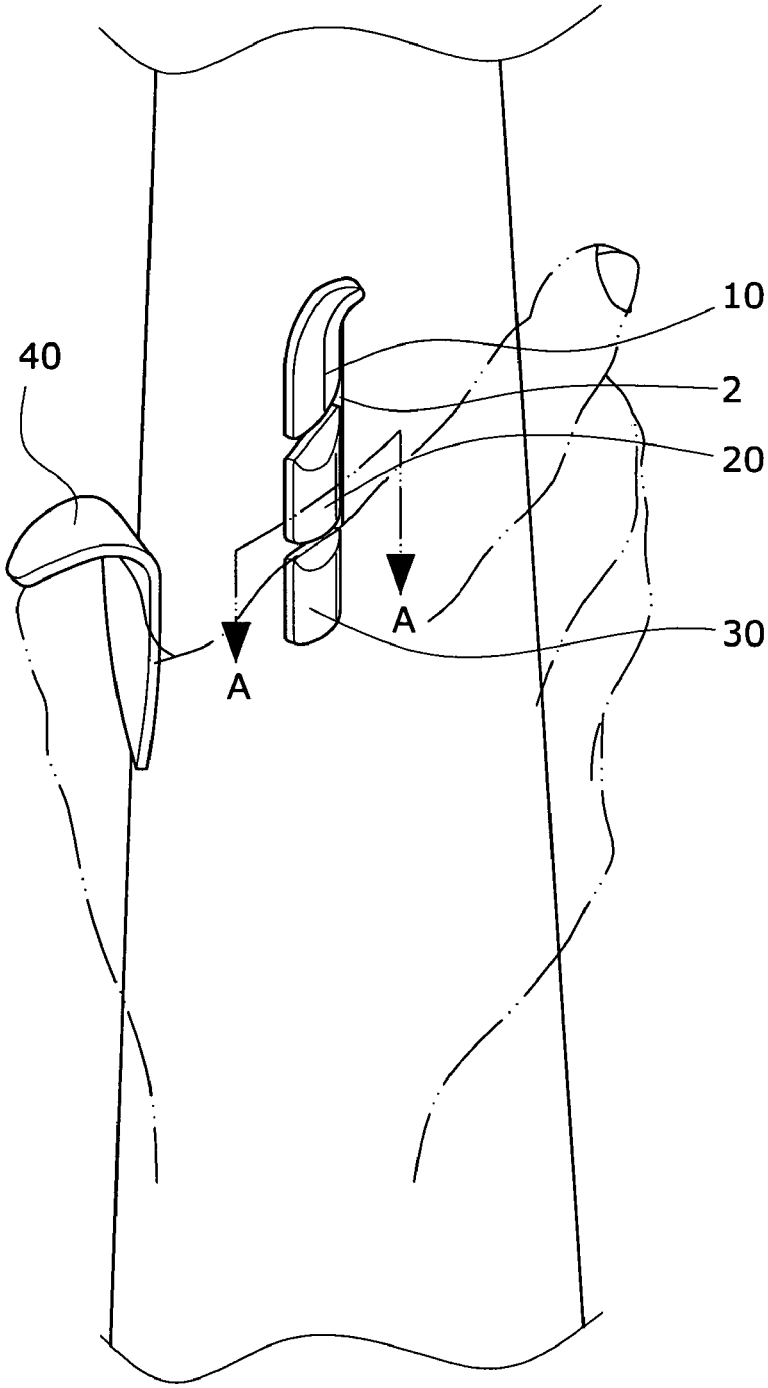
FIG. 3 is a perspective view of the present invention.
Figure 3A:
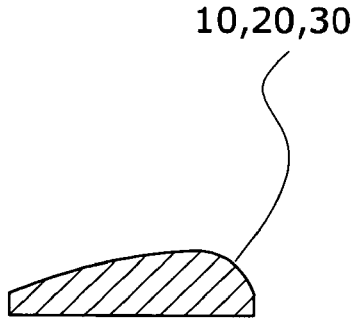
FIG. 3A is a cross-sectional view of the present invention.
Figure 4:
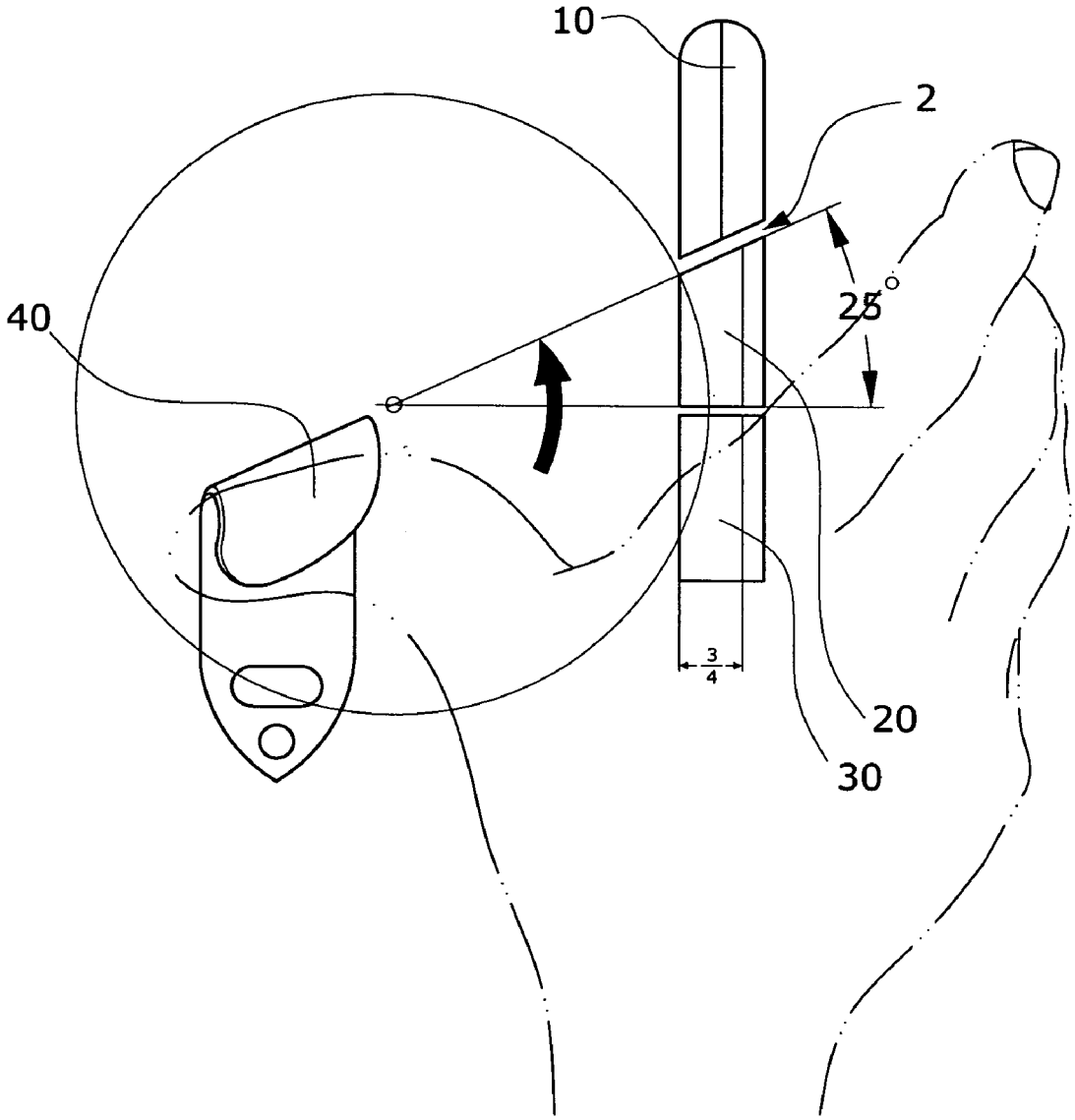
FIG. 4 is a side view of a further embodiment of the present invention.

Referring to FIG. 3, FIG. 3A and FIG. 4, the present invention comprises of a treble E button 10, a side C linking rod button 20 and a side Bb linking rod button 30; the bottom of the treble E button 10 and the top of the side C linking rod button 20 oblique upward 25° from left to right, the intersection 2 and the horizontal direction of the finger hook 40 form an upward 25° angle; the highest curve point of the side C linking rod button 20 and the side Bb linking rod button 30 are on the ¾ of the side C linking rod button 20 and the side Bb linking rod button 30 respectively, then declines from the high points downward on both sides to the rims of both buttons.

Based on above description, the intersection is in 25° angle with the horizontal direction, the highest curve point of the side C linking rod button 20 and the side Bb linking rod button 30 are on the ¾ of the side C linking rod button 20 and a side Bb linking rod button 30 respectively; such design not only meet ergonomics requirement, players also fell the reduction of the height difference and increase the contact area while playing.

While a preferred embodiment of the invention has been shown and described in detail, it will be readily understood and appreciated that numerous omissions, changes and additions may be made without departing from the spirit and scope of the invention.

What is claimed is:

1. A button structure of a saxophone comprising:

a treble E button, a side C linking rod button and a side Bb linking rod button, wherein a bottom of said treble E button and a top of said side C linking rod button slope obliquely upward 25° from left to right, and a most prominent part of each of said side C linking rod button and said side Bb linking rod button are positioned ¾ of a distance from left to right of said side C linking rod button and said side Bb linking rod button respectively, said side C linking rod button and said side Bb linking rod button each being of a convexly curved form.

2. The button structure recited in claim 1, wherein an intersection of said treble E button, the top of said side C linking rod button and a horizontal direction of a finger hook form an upward 25° angle.

* * * * *